US010166600B2

(12) United States Patent
Egawa

(10) Patent No.: US 10,166,600 B2
(45) Date of Patent: Jan. 1, 2019

(54) FORMED BODY MANUFACTURING METHOD AND FORMED BODY MANUFACTURING APPARATUS

(71) Applicant: TOYOTA JIDOSHA KABUSHIKI KAISHA, Toyota-shi (JP)

(72) Inventor: Yuta Egawa, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/792,958

(22) Filed: Oct. 25, 2017

(65) Prior Publication Data

US 2018/0126451 A1 May 10, 2018

(30) Foreign Application Priority Data

Nov. 8, 2016 (JP) ..... 2016-218099

(51) Int. Cl.
*B22D 11/01* (2006.01)
*B22D 11/14* (2006.01)
(Continued)

(52) U.S. Cl.
CPC ..... *B22D 11/01* (2013.01); *B22D 11/145* (2013.01); *B22D 23/003* (2013.01);
(Continued)

(58) Field of Classification Search
CPC ... B22D 11/01; B22D 11/145; B22D 11/1213; B22D 11/1246; B22D 23/003; B22D 27/045
See application file for complete search history.

(56) References Cited

U.S. PATENT DOCUMENTS

2008/0035298 A1* 2/2008 Yu ..... B22D 11/22 164/455
2013/0171021 A1 7/2013 Yaokawa et al.

FOREIGN PATENT DOCUMENTS

JP 57-202683 12/1982
JP 2009-152537 7/2009
(Continued)

OTHER PUBLICATIONS

U.S. Appl. No. 15/684,333, filed Aug. 23, 2017, Naoaki Sugiura, et al. (publication date not available, submitting filed of application).

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

In a formed body manufacturing method, molten metal is led out from a molten metal surface of the molten metal held in a holding furnace and is passed through a shape defining member configured to define a sectional shape of the formed body, and the formed body manufacturing method includes: measuring a surface temperature of the formed body formed such that retained molten metal that has passed through the shape defining member solidifies; adjusting a height of a coating material spray nozzle based on a result of the measurement of the surface temperature of the formed body so that the surface temperature of the formed body to which the heat dissipation coating material is blown becomes a solidifying point of the molten metal or less; and spraying the heat dissipation coating material to a surface of the formed body from the coating material spray nozzle.

4 Claims, 5 Drawing Sheets

(51) Int. Cl.

| | |
|---|---|
| ***B22D 23/00*** | (2006.01) |
| ***B22D 27/04*** | (2006.01) |
| *B22D 11/12* | (2006.01) |
| *B22D 11/124* | (2006.01) |

(52) U.S. Cl.
CPC ..... *B22D 27/045* (2013.01); *B22D 11/1213* (2013.01); *B22D 11/1246* (2013.01)

(56) References Cited

FOREIGN PATENT DOCUMENTS

| | | | | |
|---|---|---|---|---|
| JP | 5373728 | | 12/2013 | |
| WO | WO-2015136363 | A1 * | 9/2015 | ..... B22D 11/145 |

* cited by examiner

FORMED BODY MANUFACTURING METHOD AND FORMED BODY MANUFACTURING APPARATUS

INCORPORATION BY REFERENCE

The disclosure of Japanese Patent Application No. 2016-218099 filed on Nov. 8, 2016 including the specification, drawings and abstract is incorporated herein by reference in its entirety.

BACKGROUND

1. Technical Field

The present disclosure relates to a formed body manufacturing method and a formed body manufacturing apparatus.

2. Description of Related Art

Japanese Patent No. 5373728 discloses a device for manufacturing a metal formed body. In the device disclosed in Japanese Patent No. 5373728, when a starter is immersed into a surface of molten metal (that is, a molten metal surface) and then the starter is lifted up, the molten metal is also led out following the starter due to a surface film and a surface tension of the molten metal. Here, formed bodies having a desired sectional shape can be continuously formed such that the molten metal is led out via a shape defining member placed on the molten metal surface, and then, the molten metal thus led out is cooled.

In the device disclosed in Japanese Patent No. 5373728, the shape defining member defines only the sectional shape of the formed body, and does not define a longitudinal shape of the formed body. On that account, formed bodies having various longitudinal shapes can be formed by lifting the starter while moving the shape defining member (or the starter) in a horizontal direction. More specifically, Japanese Patent No. 5373728 discloses a hollow formed body (that is, a pipe) formed not in a linear shape in its longitudinal direction, but in a zigzag shape or a helical shape in the longitudinal direction.

SUMMARY

In the meantime, it is demanded to manufacture a formed body such as a heat sink having a thermal radiation property efficiently with high quality. The formed body having a thermal radiation property is formed, for example, such that a resin-containing coating material having a property of solidifying at a high temperature is applied to a surface of the formed body that is heated, so as to form a heat dissipation coating.

Here, if the resin-containing coating material can be blown to the surface of the formed body in a high temperature state in the middle of forming by the device disclosed in Japanese Patent No. 5373728, the heat dissipation coating can be formed on the surface of the formed body efficiently without heating the formed body additionally.

However, in this method, in a case where the coating material is blown to the molten metal lifted up from the molten metal surface but not solidifying yet, a sectional shape of the molten metal not solidifying yet deforms due to a blowing pressure, which might decrease quality of the formed body.

The present disclosure provides a formed body manufacturing method and a formed body manufacturing apparatus, each of which can efficiently form a heat dissipation coating on a surface of a formed body without decreasing quality of the formed body.

A formed body manufacturing method according to one aspect of the present disclosure is a formed body manufacturing method for manufacturing a formed body such that molten metal is led out from a molten metal surface of the molten metal held in a holding furnace and is passed through a shape defining member configured to define a sectional shape of the formed body, and the formed body manufacturing method includes: a step of measuring a surface temperature of the formed body formed such that the molten metal that has passed through the shape defining member solidifies; a step of adjusting a height of a coating material spray nozzle based on a result of the measurement of the surface temperature of the formed body so that the surface temperature of the formed body to which a heat dissipation coating material is blown becomes a solidifying point of the molten metal or less; and a step of spraying the heat dissipation coating material to a surface of the formed body from the coating material spray nozzle. This can prevent the heat dissipation coating material from being blown to the molten metal lifted up from the molten metal surface but not solidifying yet, thereby making it possible to prevent a decrease of quality of the formed body.

The formed body manufacturing method according to the one aspect of the present disclosure may be configured such that: the coating material spray nozzle is moved upward based on the result of the measurement of the surface temperature of the formed body so that the surface temperature of the formed body to which the heat dissipation coating material is blown becomes the solidifying point of the molten metal or less; and after that, when it is determined that the surface temperature of the formed body to which the heat dissipation coating material is blown is the solidifying point of the molten metal or less, the height of the coating material spray nozzle is fixed.

In the adjusting of the height of the coating material spray nozzle, the height of the coating material spray nozzle may be adjusted so that the surface temperature of the formed body to which the heat dissipation coating material is blown is not less than a temperature at which the heat dissipation coating material solidifies, but less than a temperature at which the heat dissipation coating material decomposes. Hereby, the heat dissipation coating material blown to the surface of the formed body in a high temperature state solidifies normally, so that the heat dissipation coating can be formed on the surface of the formed body efficiently with high quality.

The formed body manufacturing method according to the one aspect of the present disclosure may be configured such that: when it is determined that the surface temperature of the formed body to which the heat dissipation coating material is blown is not less than the temperature at which the heat dissipation coating material solidifies, the coating material spray nozzle is moved upward; when it is determined that the surface temperature of the formed body to which the heat dissipation coating material is blown is less than the temperature at which the heat dissipation coating material decomposes, and less than a temperature sufficient for the heat dissipation coating material to solidify, the coating material spray nozzle is moved downward; and after that, when it is determined that the surface temperature of the formed body to which the heat dissipation coating material is blown is not less than the temperature at which the heat dissipation coating material solidifies, but less than the temperature at which the heat dissipation coating material decomposes, the coating material spray nozzle is fixed.

A formed body manufacturing apparatus according to one aspect of the present disclosure is a formed body manufacturing apparatus including: a holding furnace configured to hold the molten metal; and a shape defining member placed on a molten metal surface of the molten metal and configured to define a sectional shape of a formed body to be manufactured when the molten metal led out from the molten metal surface passes through the shape defining member, and further includes: a temperature measuring device configured to measure a surface temperature of the formed body formed such that the molten metal that has passed through the shape defining member solidifies; a coating material spray nozzle configured to spray a heat dissipation coating material to a surface of the formed body formed such that the molten metal that has passed through the shape defining member solidifies; and an actuator configured to drive the coating material spray nozzle in an up-down direction. The formed body manufacturing apparatus adjusts a height of the coating material spray nozzle based on a measurement result by the temperature measuring device so that the surface temperature of the formed body to which the heat dissipation coating material is blown becomes a solidifying point of the molten metal or less. This can prevent the heat dissipation coating material from being blown to the molten metal lifted up from the molten metal surface but not solidifying yet, thereby making it possible to prevent a decrease of quality of the formed body.

The formed body manufacturing apparatus according to the one aspect of the present disclosure may be configured such that the coating material spray nozzle is moved upward based on a result of the measurement of the surface temperature of the formed body so that the surface temperature of the formed body to which the heat dissipation coating material is blown becomes the solidifying point of the molten metal or less; and after that, when it is determined that the surface temperature of the formed body to which the heat dissipation coating material is blown is the solidifying point of the molten metal or less, the height of the coating material spray nozzle is fixed.

The height of the coating material spray nozzle may be adjusted so that the surface temperature of the formed body to which the heat dissipation coating material is blown is not less than a temperature at which the heat dissipation coating material solidifies, but less than a temperature at which the heat dissipation coating material decomposes. Hereby, the heat dissipation coating material blown to the surface of the formed body in a high temperature state solidifies normally, so that the heat dissipation coating can be formed on the surface of the formed body efficiently with high quality.

The formed body manufacturing apparatus according to the one aspect of the present disclosure may be configured such that: when it is determined that the surface temperature of the formed body to which the heat dissipation coating material is blown is not less than the temperature at which the heat dissipation coating material solidifies, the coating material spray nozzle is moved upward; when it is determined that the surface temperature of the formed body to which the heat dissipation coating material is blown is less than the temperature at which the heat dissipation coating material decomposes, and less than a temperature sufficient for the heat dissipation coating material to solidify, the coating material spray nozzle is moved downward; and after that, when it is determined that the surface temperature of the formed body to which the heat dissipation coating material is blown is not less than the temperature at which the heat dissipation coating material solidifies, but less than the temperature at which the heat dissipation coating material decomposes, the coating material spray nozzle is fixed.

The present disclosure can provide a formed body manufacturing method and a formed body manufacturing apparatus, each of which can efficiently form a heat dissipation coating on a surface of a formed body without decreasing quality of the formed body.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

The following describes concrete embodiments to which the present disclosure is applied with reference to the drawings. However, the present disclosure is not limited to the following embodiments. Further, the following description and drawings are simplified appropriately for clarification of the description.

Embodiment 1

Figure 1:
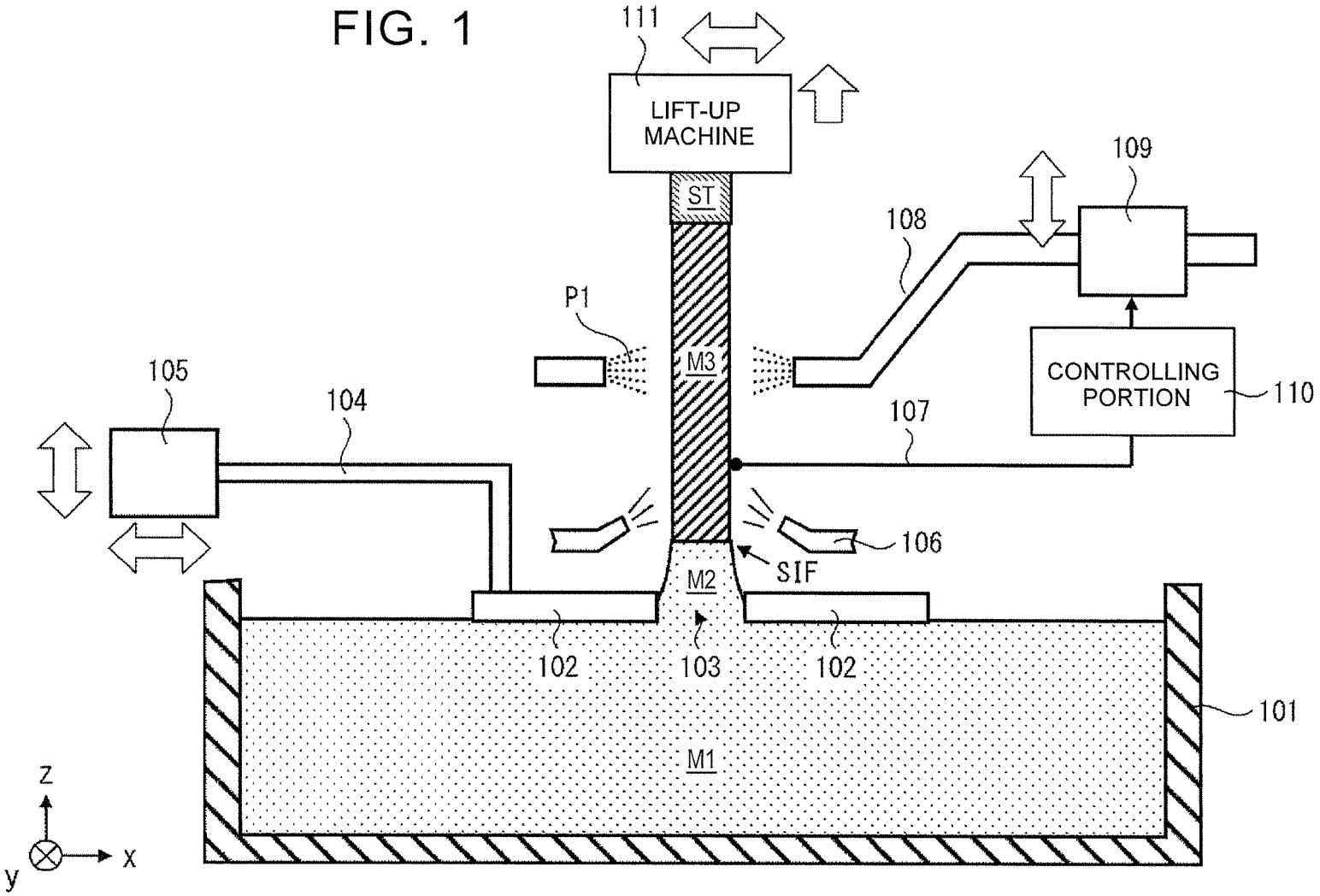
FIG. 1 is a sectional view schematically illustrating a formed body manufacturing apparatus according to Embodiment 1.

First described is a formed body manufacturing apparatus according to Embodiment 1, with reference to FIG. 1. FIG. 1 is a sectional view schematically illustrating the formed body manufacturing apparatus according to Embodiment 1. As illustrated in FIG. 1, the formed body manufacturing apparatus according to Embodiment 1 includes a molten metal holding furnace (holding furnace) 101, a shape defining member 102, a support rod 104, an actuator 105, a coolant gas nozzle 106, a thermoelectric couple 107, a coating material spray nozzle 108, an actuator 109, a controlling portion 110, and a lift-up machine 111. Note that an xyz right coordinate system is illustrated in FIG. 1 for convenience of description of a positional relationship between constituents. An xy plane in FIG. 1 constitutes a horizontal plane, and a z-axis direction is a vertical direction. More specifically, a positive direction of the z axis is an upper side in the vertical direction.

The molten metal holding furnace 101 stores therein molten metal M1 of aluminum or its alloy, for example, and keeps the molten metal M1 at a predetermined temperature at which the molten metal M1 has fluidity. In an example of FIG. 1, the molten metal holding furnace 101 is not supplemented with the molten metal M1 during manufacture of a formed body M3, so a surface (that is, a molten metal surface) of the molten metal M1 gradually decreases. In the meantime, the molten metal M1 may be replenished, as needed, into the molten metal holding furnace 101 during the manufacture of the formed body M3, such that the molten metal surface is kept constant. Here, when a preset temperature of the molten metal holding furnace 101 is increased, a position of a solidification interface SIF can be raised. When the preset temperature of the molten metal holding furnace 101 is decreased, the position of the solidification interface SIF can be lowered. Naturally, the molten metal M1 may be made of other metal or its alloy other than aluminum.

The shape defining member 102 is made of ceramics or stainless, for example, and is placed on the molten metal surface. The shape defining member 102 defines a sectional shape of the formed body M3 to be manufactured. The formed body M3 illustrated in FIG. 1 is a solid member, a horizontal section (hereinafter referred to as a transverse section) of which has a circular shape. Naturally, the sectional shape of the formed body M3 is not limited in particular. That is, a shape of the transverse section of the formed body M3 may be rectangular, and the formed body M3 may be a hollow member such as a circular pipe or a square pipe.

In the example illustrated in FIG. 1, the shape defining member 102 is placed so that its principal plane (a bottom face) on a lower side makes contact with the molten metal surface. This prevents an oxide film formed on the surface of the molten metal M1 and foreign matters floating on the surface of the molten metal M1 from mixing into the formed body M3. In the meantime, the shape defining member 102 may be placed so that its bottom face does not make contact with the molten metal surface. More specifically, the shape defining member 102 may be placed so that its bottom face is distanced from the molten metal surface by a predetermined distance (e.g., around 0.5 mm). Hereby, heat deformation and erosion of the shape defining member 102 are restrained, so durability thereof is improved.

Figure 2:
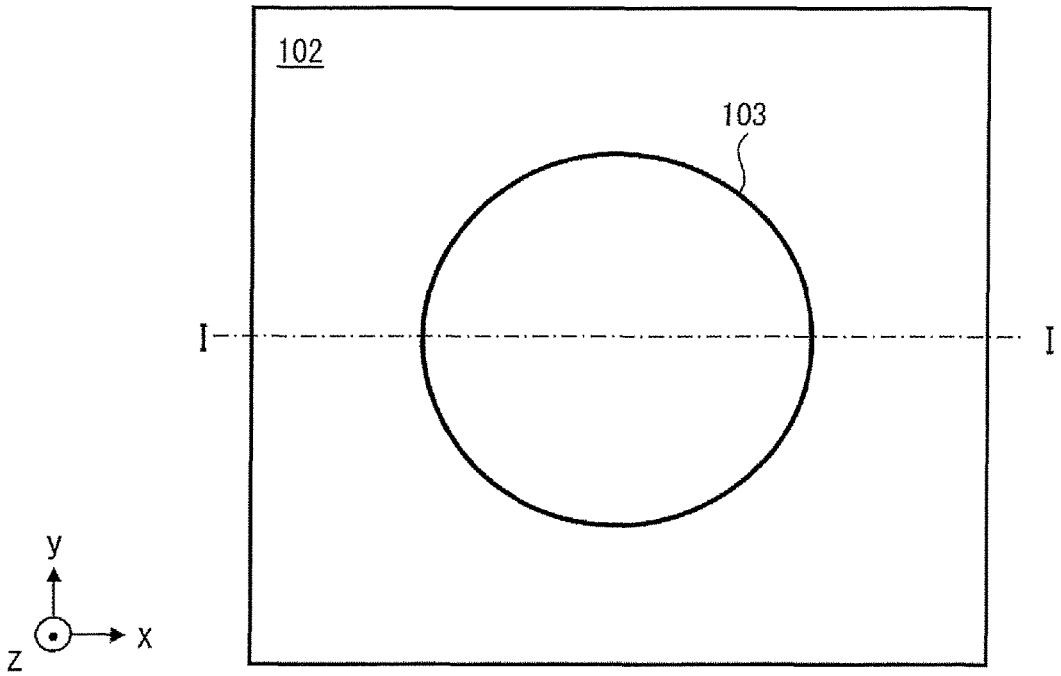
FIG. 2 is a plan view of a shape defining member illustrated in FIG. 1.

FIG. 2 is a plan view of the shape defining member 102 illustrated in FIG. 1. Here, the sectional view of the shape defining member 102 of FIG. 1 corresponds to a sectional view taken along a line I-I in FIG. 2. In the example of FIG. 2, the shape defining member 102 has a rectangular planar shape and has a round opening in its central part. The opening serves as a molten metal passage portion 103 through which the molten metal M1 passes. Note that an xyz coordinate in FIG. 2 is the same coordinate as in FIG. 1.

As illustrated in FIG. 1, after the molten metal M1 is connected to a starter ST immersed therein, the molten metal M1 is lifted up following the starter ST with its outer shape being maintained due to a surface film and a surface tension thereof, and passes through the molten metal passage portion 103 of the shape defining member 102. When the molten metal M1 passes through the molten metal passage portion 103 of the shape defining member 102, an external force is applied to the molten metal M1 from the shape defining member 102, so that a sectional shape of the formed body M3 is defined. Here, the molten metal lifted up from the molten metal surface, following the starter ST (or the formed body M3 formed such that the molten metal M1 thus lifted up following the starter ST solidifies) due to the surface film and the surface tension of the molten metal M1, is referred to as retained molten metal M2. Further, a boundary between the formed body M3 and the retained molten metal M2 is the solidification interface SIF.

The support rod 104 supports the shape defining member 102. The support rod 104 is connected to the actuator 105.

The actuator 105 can move the shape defining member 102 in an up-down direction (a z-axis direction) via the support rod 104. This makes it possible to move the shape defining member 102 downward along with a drop of the molten metal surface during the manufacture of the formed body M3. Further, the actuator 105 can move the shape defining member 102 in a horizontal direction (an x-axis direction and a y-axis direction) via the support rod 104. This makes it possible to change a longitudinal shape of the formed body M3 freely.

The coolant gas nozzle 106 cools the retained molten metal M2 indirectly by blowing coolant gas (e.g., air, nitrogen, argon, and the like) to the starter ST or the formed body M3. When a flow rate of the coolant gas is increased, a position of the solidification interface SIF is lowered, and when the flow rate of the coolant gas is decreased, the position of the solidification interface SIF is raised. Note that the coolant gas nozzle 106 is also movable in the up-down direction (a vertical direction; the z-axis direction) and in the horizontal direction (the x-axis direction and the y-axis direction). Accordingly, the coolant gas nozzle 106 can be moved downward along with downward movement of the shape defining member 102, along with the drop of the molten metal surface during the manufacture of the formed body M3. Alternatively, the coolant gas nozzle 106 can be moved in the horizontal direction along with horizontal movement of the lift-up machine 111 and the shape defining member 102.

When the starter ST or the formed body M3 is cooled off by the coolant gas with the formed body M3 being lifted up by the lift-up machine 111 connected to the starter ST, the retained molten metal M2 near the solidification interface SIF solidifies sequentially from an upper side (a positive side in the z-axis direction) to a lower side (a negative side in the z-axis direction), and thus, the formed body M3 is formed. When a lift-up speed by the lift-up machine 111 is increased, the position of the solidification interface SIF can be raised. When the lift-up speed is decreased, the position of the solidification interface SIF can be lowered.

Note that, instead of moving the shape defining member 102 in the horizontal direction, the lift-up machine 111 may be moved in the horizontal direction. By lifting up the lift-up machine 111 while the lift-up machine 111 is moved in the horizontal direction, the retained molten metal M2 can be led out in a diagonal direction. This makes it possible to change the longitudinal shape of the formed body M3 freely.

The thermoelectric couple 107 measures a surface temperature of the formed body M3 by bringing its temperature measuring junction into contact with the surface of the formed body M3 formed such that the retained molten metal M2 solidifies. The present embodiment deals with a case where the thermoelectric couple 107 is used as a temperature measuring device. However, the present embodiment is not limited to this, and may use a radiation thermometer and the like.

The coating material spray nozzle 108 blows a heat dissipation coating material P1 to the surface of the formed body M3. The heat dissipation coating material P1 is a resin-containing coating material having a property of solidifying at a high temperature, and is PAI (polyamideimide), for example. The coating material spray nozzle 108 can be moved in the up-down direction (the z-axis direction) by the actuator 109.

The controlling portion 110 controls the actuator 109 based on a measurement result by the thermoelectric couple 107. Hereby, a height (a position in the z-axis direction) of the coating material spray nozzle 108 is adjusted.

Here, the controlling portion 110 stores the information of a temperature gradient of the surface temperature of the formed body M3 evaluated in advance. On that account, the controlling portion 110 can specify a surface temperature of the formed body M3 at a spray position of the coating material spray nozzle 108, based on a surface temperature of the formed body M3 at a measuring position of the thermoelectric couple 107. Note that the temperature gradient of the surface temperature of the formed body M3 varies depending on a material of the molten metal M1 (the formed body M3), a lift-up speed, a cooling strength by the coolant gas, and the like.

For example, in a case where the surface temperature of the formed body M3 to which the heat dissipation coating material P1 is blown is too high, the controlling portion 110 moves the coating material spray nozzle 108 upward, and in a case where the surface temperature of the formed body M3 to which the heat dissipation coating material P1 is blown is too low, the controlling portion 110 moves the coating material spray nozzle 108 downward.

Figure 3:
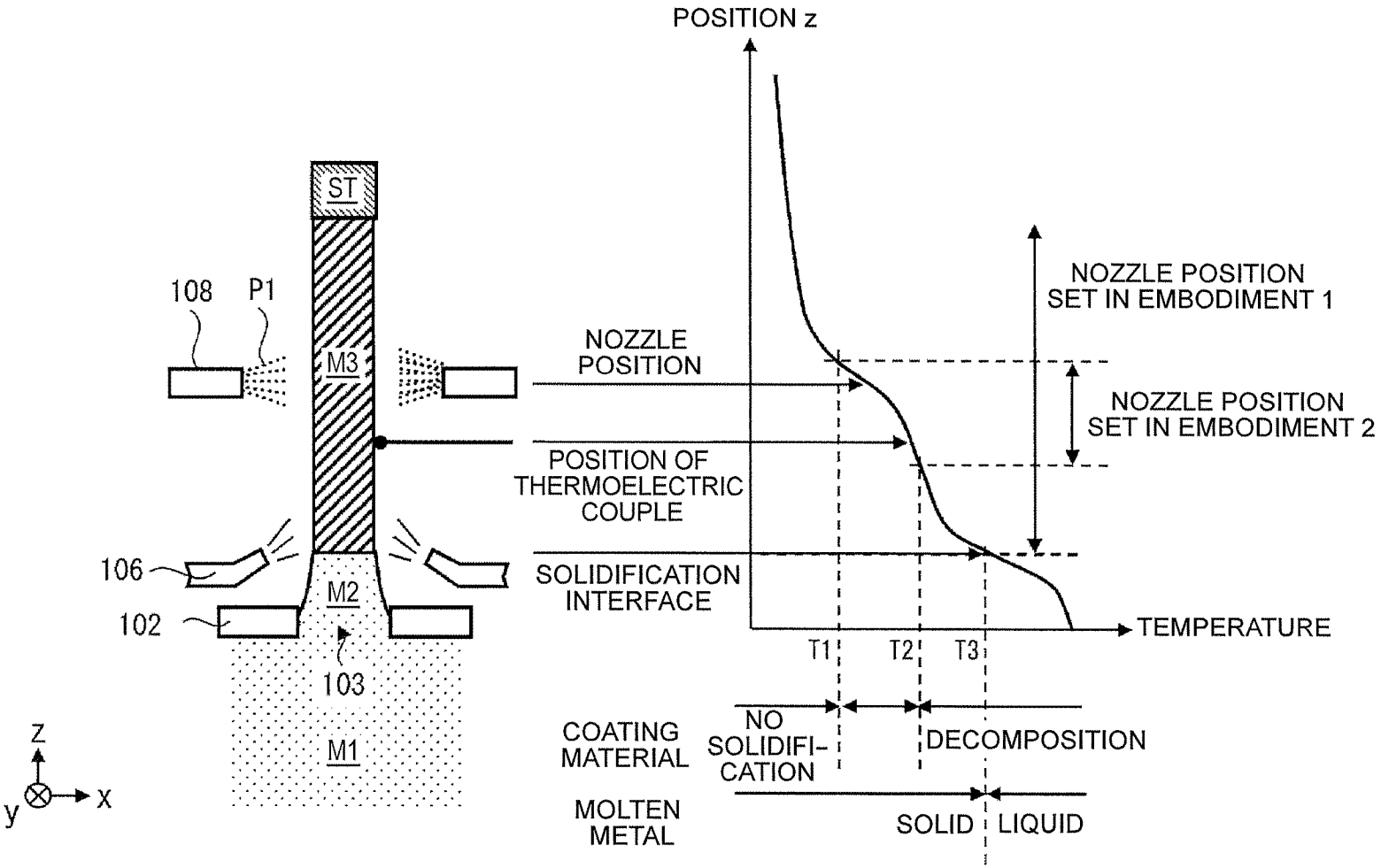
FIG. 3 is a view illustrating an example of a temperature gradient of a surface temperature of a formed body manufactured by the formed body manufacturing apparatus illustrated in FIG. 1.

FIG. 3 is a view illustrating an example of the temperature gradient of the surface temperature of the formed body M3 (and the retained molten metal M2). In the example of FIG. 3, a horizontal axis indicates a surface temperature, and a vertical axis indicates a height (a position in the z-axis direction) from the molten metal surface. Referring to FIG. 3, the surface temperature indicates a value higher than a solidifying point T3 (e.g., approximately 660 degrees) of the molten metal M1 from the molten metal surface to the solidification interface SIF. That is, the molten metal M1 is retained as a liquid (that is, the retained molten metal M2). After that, the surface temperature reaches the solidifying point T3 of the molten metal M1 on the solidification interface SIF, and gradually decreases as the molten metal M1 is positioned higher from the solidification interface SIF. That is, the molten metal M1 solidifies to become the formed body M3.

In view of this, the controlling portion 110 adjusts a height of the coating material spray nozzle 108 so that the surface temperature of the formed body M3 to which the heat dissipation coating material P1 is blown becomes the solidifying point T3 of the molten metal M1 or less. This can prevent the heat dissipation coating material P1 from being blown to the retained molten metal M2, thereby making it possible to prevent a decrease of quality of the formed body M3.

Figure 4:
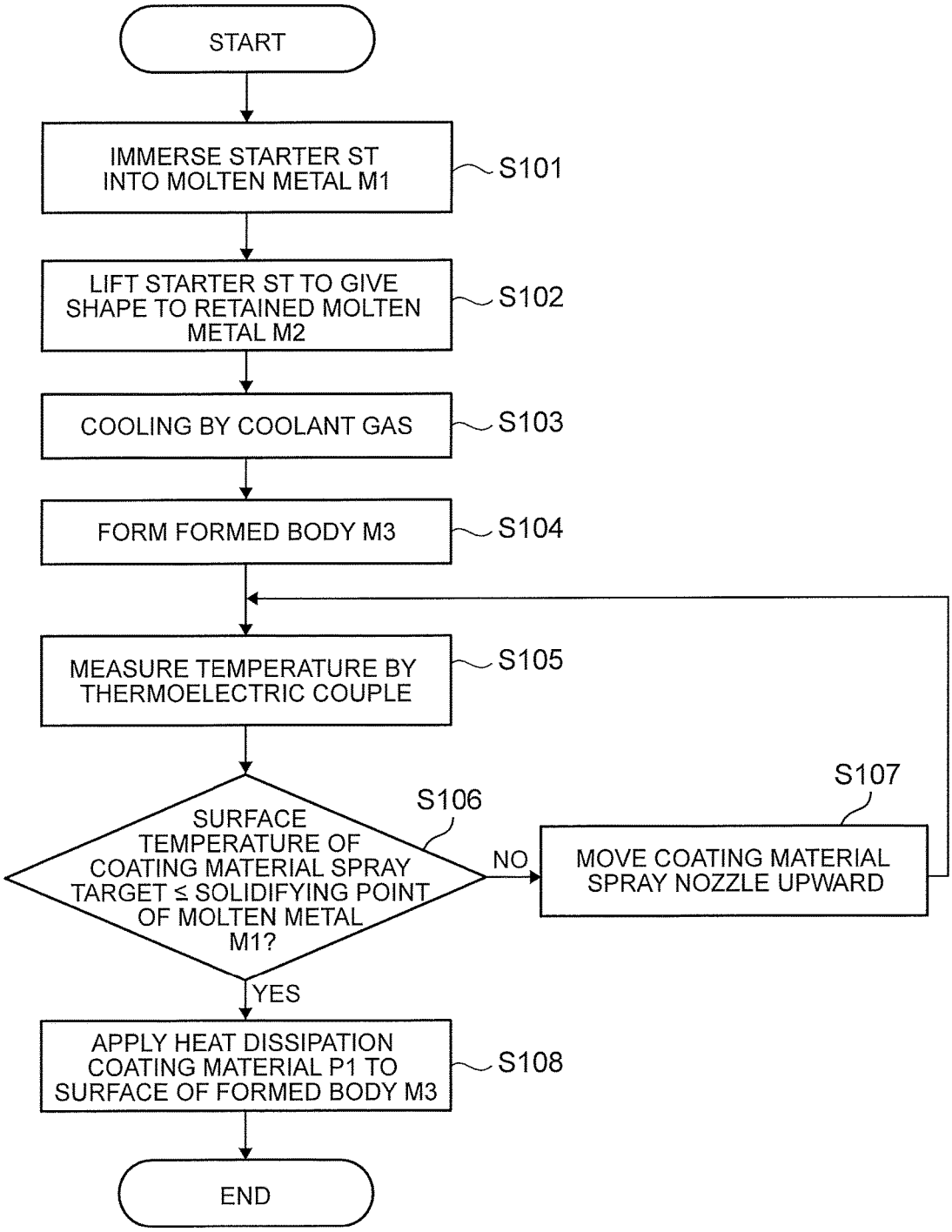
FIG. 4 is a flowchart illustrating a formed body manufacturing method according to Embodiment 1.

Next will be described a formed body manufacturing method according to Embodiment 1, with reference to FIGS. 1 to 4. FIG. 4 is a flowchart illustrating the formed body manufacturing method according to Embodiment 1.

First, the starter ST is moved downward by the lift-up machine 111, so that a tip end of the starter ST is immersed into the molten metal M1 through the molten metal passage portion 103 of the shape defining member 102 (step S101).

Then, lifting of the starter ST is started at a predetermined speed. Here, even if the starter ST is distanced from the molten metal surface, the molten metal M1 is lifted up (led out) from the molten metal surface, following the starter ST, due to a surface film and a surface tension thereof, so that the retained molten metal M2 is formed. As illustrated in FIG. 1, the retained molten metal M2 is formed in the molten metal passage portion 103 of the shape defining member 102. That is, a shape is given to the retained molten metal M2 by the shape defining member 102 (step S102).

Then, the starter ST or the formed body M3 formed such that the retained molten metal M2 solidifies is cooled off by the coolant gas sprayed from the coolant gas nozzle 106 (step S103). Hereby, the retained molten metal M2 continuing from the starter ST or the formed body M3 is cooled off indirectly and solidifies sequentially from the upper side to the lower side, so that the formed body M3 grows (step S104). Thus, the formed bodies M3 can be formed continuously.

Here, a surface temperature of the formed body M3 at a predetermined height from the molten metal surface is measured by the thermoelectric couple 107 (step S105). When it is determined, based on the measurement result by the thermoelectric couple 107, that the surface temperature of the formed body M3 to which the heat dissipation coating material P1 is blown is higher than the solidifying point of the molten metal M1 (NO in step S106), the controlling portion 110 moves the coating material spray nozzle 108 upward (step S107). After that, the temperature measurement by the thermoelectric couple 107 is performed again (step S105).

After that, when it is determined that the surface temperature of the formed body M3 to which the heat dissipation coating material P1 is blown is the solidifying point of the molten metal M1 or less (YES in step S106), the controlling portion 110 fixes the height of the coating material spray nozzle 108 and blows the heat dissipation coating material P1 to the surface of the formed body M3. Hereby, a heat dissipation coating is formed on the surface of the formed body M3 (step S108).

As such, in the formed body manufacturing apparatus of Embodiment 1, the height of the coating material spray nozzle 108 is adjusted, so that the surface temperature of the formed body M3 to which the heat dissipation coating material P1 is blown becomes the solidifying point T3 of the molten metal M1 or less. This can prevent the heat dissipation coating material P1 from being blown to the retained molten metal M2, thereby making it possible to prevent a decrease of quality of the formed body M3.

Embodiment 2

Figure 5:
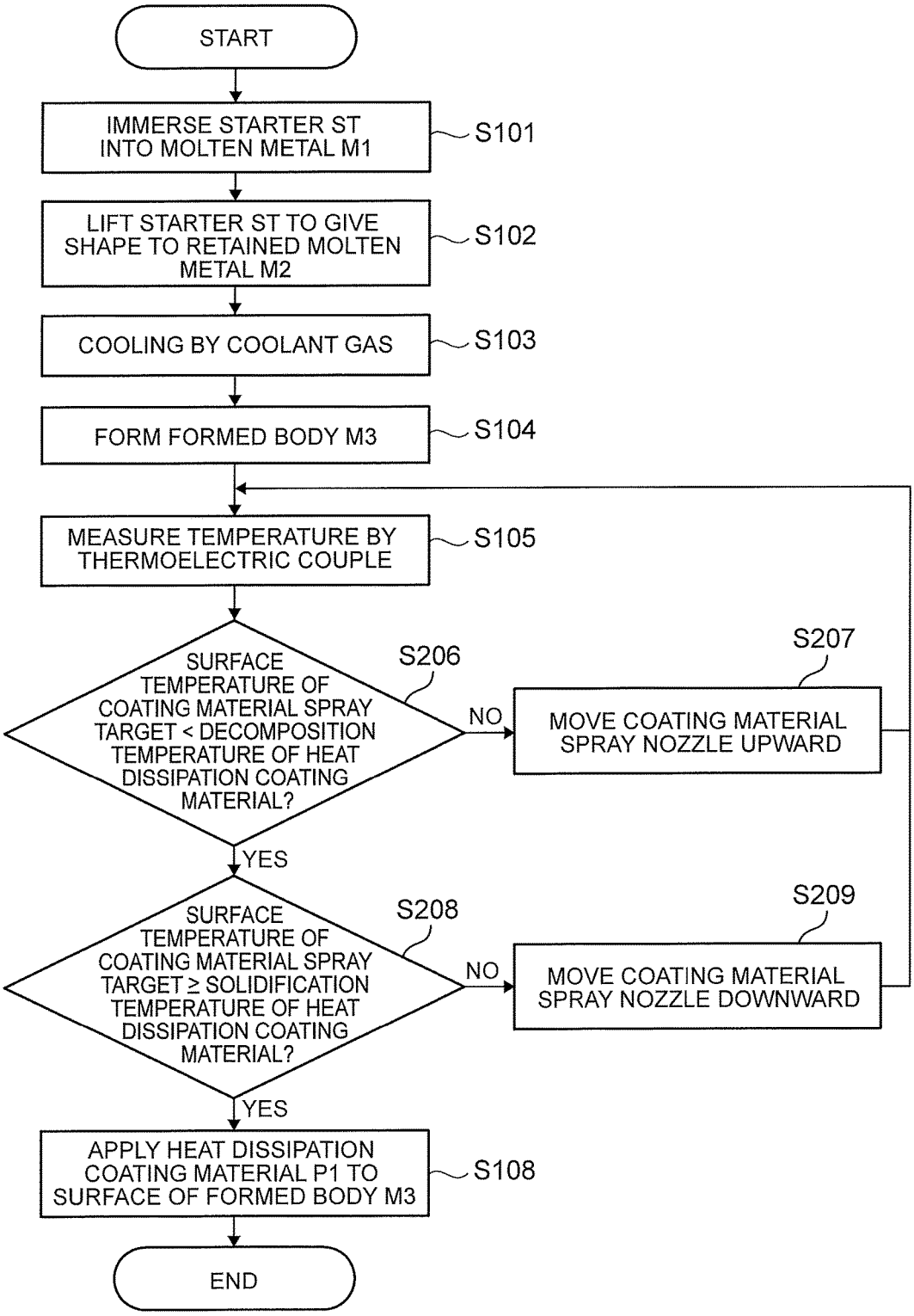
FIG. 5 is a flowchart illustrating a formed body manufacturing method according to Embodiment 2.

FIG. 5 is a flowchart illustrating a formed body manufacturing method according to Embodiment 2. The formed body manufacturing method according to Embodiment 2 is different from the formed body manufacturing method according to Embodiment 1 in how to adjust the coating material spray nozzle 108 based on the measurement result by the thermoelectric couple 107.

As illustrated in FIG. 5, when it is determined that a surface temperature of a formed body M3 to which a heat dissipation coating material P1 is blown is not less than a temperature T2 (see FIG. 3) at which the heat dissipation coating material P1 decomposes (NO in step S206), a controlling portion 110 moves a coating material spray nozzle 108 upward (step S207). Further, even in a case where the surface temperature of the formed body M3 to which the heat dissipation coating material P1 is blown is less than the temperature T2 at which the heat dissipation coating material P1 decomposes (YES in step S206), if it is determined that the surface temperature is less than a temperature T1 (see FIG. 3) sufficient for the heat dissipation coating material P1 to solidify (NO in step S208), the controlling portion 110 moves the coating material spray nozzle 108 downward (step S209). After that, the temperature measurement by a thermoelectric couple 107 is performed again (step S105).

After that, when it is determined that the surface temperature of the formed body M3 to which the heat dissipation coating material P1 is blown is not less than the temperature T1 (180 degrees in a case of polyamideimide) at which the heat dissipation coating material P1 solidifies, but less than the temperature T2 (400 degrees in the case of polyamideimide) at which the heat dissipation coating material P1 decomposes (YES in step S208), the controlling portion 110 fixes a height of the coating material spray nozzle 108 and blows the heat dissipation coating material P1 to the surface of the formed body M3. Hereby, a heat dissipation coating is formed on the surface of the formed body M3 (step S108).

As such, in the formed body manufacturing apparatus according to Embodiment 2, the height of the coating material spray nozzle 108 is adjusted so that the surface temperature of the formed body M3 to which the heat dissipation coating material P1 is blown is not less than the temperature T1 at which the heat dissipation coating material P1 solidifies, but less than the temperature T2 at which the heat dissipation coating material P1 decomposes. Hereby, the heat dissipation coating material P1 blown to the surface of the formed body in a high temperature state solidifies normally, so that the heat dissipation coating can be formed on the surface of the formed body efficiently with high quality.

Note that the present disclosure is not limited to the above embodiment, and various modifications can be made within a range that does not deviate from a gist of the present disclosure.

What is claimed is:

1. A formed body manufacturing method for manufacturing a formed body such that molten metal is led out from a molten metal surface of the molten metal held in a holding furnace and is passed through a shape defining member configured to define a sectional shape of the formed body, the formed body manufacturing method comprising:

measuring a surface temperature of the formed body formed such that the molten metal that has passed through the shape defining member solidifies;

adjusting a height of a coating material spray nozzle based on a result of the measurement of the surface temperature of the formed body so that the surface temperature of the formed body to which a heat dissipation coating material is blown becomes a solidifying point of the molten metal or less; and spraying the heat dissipation coating material to a surface of the formed body from the coating material spray nozzle.

2. The formed body manufacturing method according to claim 1, wherein the coating material spray nozzle is moved upward based on the result of the measurement of the surface temperature of the formed body so that the surface temperature of the formed body to which the heat dissipation coating material is blown becomes the solidifying point of the molten metal or less; and after that, when it is determined that the surface temperature of the formed body to which the heat dissipation coating material is blown is the solidifying point of the molten metal or less, the height of the coating material spray nozzle is fixed.

3. The formed body manufacturing method according to claim 1, wherein in the adjusting of the height of the coating material spray nozzle, the height of the coating material spray nozzle is adjusted so that the surface temperature of the formed body to which the heat dissipation coating material is blown is not less than a temperature at which the heat dissipation coating material solidifies, but less than a temperature at which the heat dissipation coating material decomposes.

4. The formed body manufacturing method according to claim 1, wherein when it is determined that the surface temperature of the formed body to which the heat dissipation coating material is blown is not less than a temperature at which the heat dissipation coating material solidifies, the coating material spray nozzle is moved upward;

when it is determined that the surface temperature of the formed body to which the heat dissipation coating material is blown is less than a temperature at which the heat dissipation coating material decomposes, and less than a temperature sufficient for the heat dissipation coating material to solidify, the coating material spray nozzle is moved downward; and after that, when it is determined that the surface temperature of the formed body to which the heat dissipation coating material is blown is not less than the temperature at which the heat dissipation coating material solidifies, but less than the temperature at which the heat dissipation coating material decomposes, the coating material spray nozzle is fixed.

* * * * *